US010166791B2

(12) United States Patent
Barco Oria et al.

(10) Patent No.: US 10,166,791 B2
(45) Date of Patent: Jan. 1, 2019

(54) PRINT MEDIA CUTTERS FOR PRINTING APPARATUS

(71) Applicant: HEWLETT-PACKARD DEVELOPMENT COMPANY, L.P., Houston, TX (US)

(72) Inventors: Javier Barco Oria, Sant Cugat del Valles (ES); Ivan Palomar Blay, Sant Cugat del Valles (ES); Inigo Benjamin Oraa Gil, Guecho (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/515,310

(22) PCT Filed: Oct. 31, 2014

(86) PCT No.: PCT/EP2014/073480

§ 371 (c)(1),
(2) Date: Mar. 29, 2017

(87) PCT Pub. No.: WO2016/066223

PCT Pub. Date: May 6, 2016

(65) Prior Publication Data

US 2017/0225493 A1 Aug. 10, 2017

(51) Int. Cl.

| | |
|---|---|
| ***B41J 2/01*** | (2006.01) |
| ***B41J 11/70*** | (2006.01) |
| ***B26D 1/08*** | (2006.01) |
| ***B26D 5/08*** | (2006.01) |

(52) U.S. Cl.
CPC ..... *B41J 11/70* (2013.01); *B26D 1/085* (2013.01); *B26D 5/08* (2013.01)

(58) Field of Classification Search
CPC ..... B26D 1/085; B26D 5/08; B41J 11/70
USPC ..... 347/101, 104; 400/611, 613, 621
See application file for complete search history.

(56) References Cited

U.S. PATENT DOCUMENTS

| | | | | |
|---|---|---|---|---|
| 4,544,293 | A | 10/1985 | Cranston et al. | |
| 5,007,340 | A | 4/1991 | Sugimoto et al. | |
| 5,503,053 | A | 4/1996 | Onishi et al. | |
| 6,089,136 | A | 7/2000 | Hinojosa et al. | |
| 6,095,007 | A | 8/2000 | Brewington et al. | |
| 6,520,701 | B2 | 2/2003 | Kaya | |
| 6,786,125 | B2 | 9/2004 | Imai | |
| 6,831,670 | B2 | 12/2004 | Fujiwara | |
| 7,059,793 | B2 | 6/2006 | Mori et al. | |
| 7,815,382 | B2 | 10/2010 | Monclus et al. | |
| 8,016,502 | B2 | 9/2011 | Akatsu et al. | |
| 2012/0297945 | A1* | 11/2012 | Cordero | B26D 1/245 83/56 |

* cited by examiner

*Primary Examiner* — An Do
(74) *Attorney, Agent, or Firm* — HP Inc. Patent Department

(57) ABSTRACT

An example print media cutter for a printing apparatus may comprise an active cutting wheel arranged to reciprocate across a print medium, and a driving arrangement to drive the active cutting wheel in rotation during displacement of the cutter in a first direction, and to be disengaged from the active cutting wheel during displacement of the cutter in a second direction opposite to the first direction.

12 Claims, 3 Drawing Sheets

PRINT MEDIA CUTTERS FOR PRINTING APPARATUS

BACKGROUND

Printing apparatus or systems may be supplied with a variety of media to be printed, including print media in the form of a print media supply roll. The print media may be transported along a media advance path to a print zone to be printed, and may subsequently be cut by a print media cutter, which may be displaced across the print media, for example in a direction at right angles to the media advance path.

BRIEF DESCRIPTION

Some non-limiting examples of the present disclosure will be described in the following with reference to the appended drawings, in which:

FIG. 1 a block diagram illustrating print media cutters according to examples disclosed herein;

FIG. 2 schematically shows in perspective view an example of a cutter as disclosed herein, in a printing apparatus;

FIG. 3 schematically shows an elevation view of an example of a cutter according to the present disclosure;

DETAILED DESCRIPTION

Print media sheets, or a web of print media from a supply roll, may be transported in a media advance direction in a printing apparatus, past a print zone in which images may be printed thereon. After being printed, the print media may be cut by a print media cutter and outputted to a storage tray, bin or the like.

Figure 1:
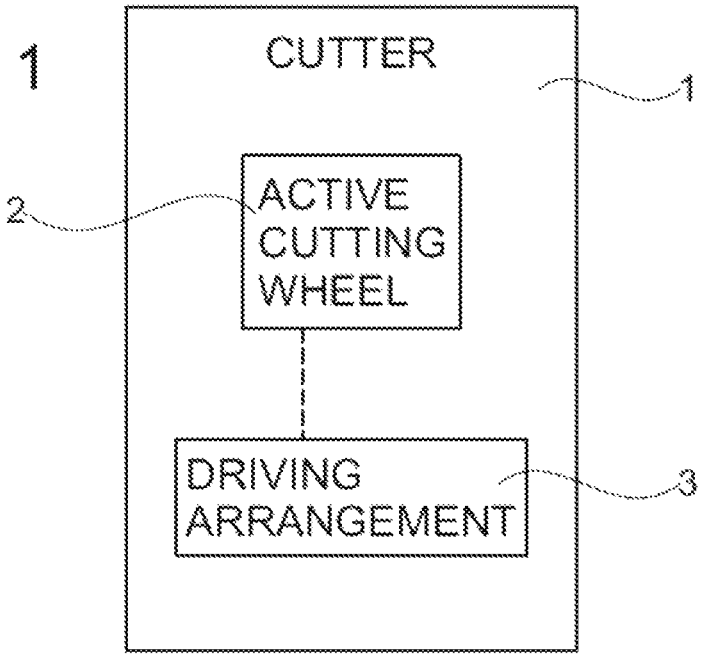

In some examples, such as shown in FIG. 1, a print media cutter 1 may comprise an active cutting wheel 2 which is displaced across the print media and a driving arrangement 3 to drive in rotation the active cutting wheel.

In some examples of the cutter as disclosed herein, the driving arrangement 3 is adapted to drive the active cutting wheel 2 in rotation during displacement of the cutter 1 in a first direction, but to be disengaged from the active cutting wheel 2 during displacement of the cutter 1 in a second direction opposite to the first direction.

This may reduce the wear of some parts of the cutter, such as the active cutting wheel, because it may avoid relative movement between some of the parts or elements of the cutter, and therefore avoid friction during some of the displacements of the cutter. For example it may avoid friction between some parts of the cutter during a return travel in which there is no print medium in the cutter path.

The overall noise due to the operation of the cutter may also be reduced.

Figure 2:
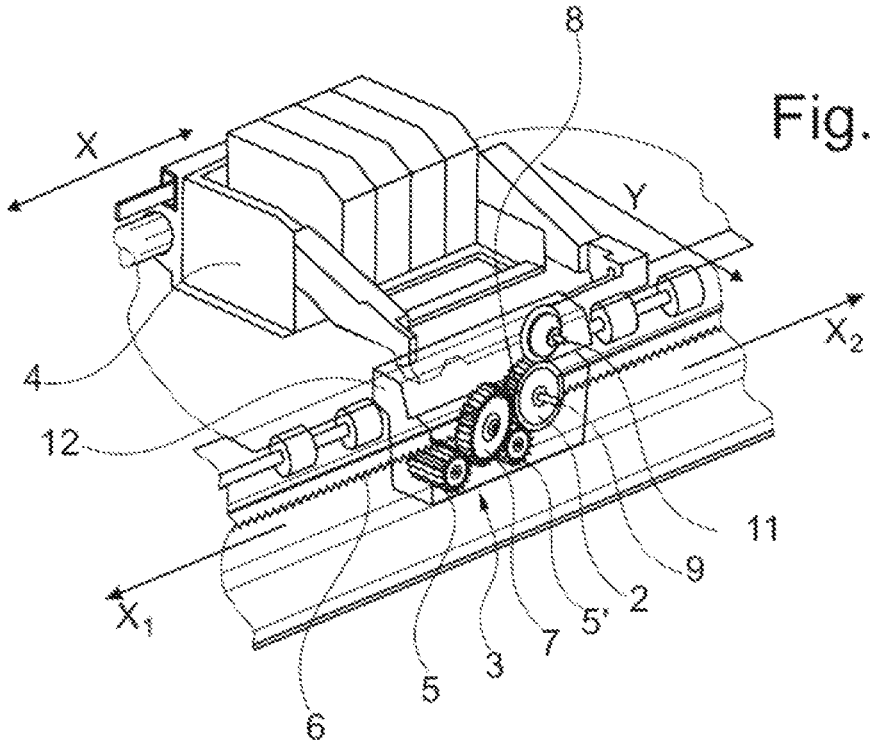

FIG. 2 shows an example of a cutter 1 mounted in a printing apparatus. The apparatus is only partially illustrated in the figure. In some examples, such as shown in this figure, the cutter 1 may be pulled or pushed across a print medium in a scan axis direction X, at right angles to a media advance direction Y, by a reciprocating printhead assembly 4 of the printing apparatus. However, the cutter 1 may also be displaced across the print medium by a motor or by other arrangements.

As shown in FIG. 2, the cutter 1 for example may be displaced across the print medium in a first direction $X_1$ and in a second direction $X_2$ opposite to the first direction $X_1$. The active cutting wheel 2 may be driven in rotation by the driving arrangement 3 during displacement of the cutter 2 in the first direction $X_1$, wherein the cutter has to cut the print medium (cutting stroke), and may be disengaged from the driving arrangement 3 during displacement of the cutter 2 in the second direction $X_2$, wherein the cutter is simply returned to its starting position without cutting the print medium (return stroke).

Figure 3:
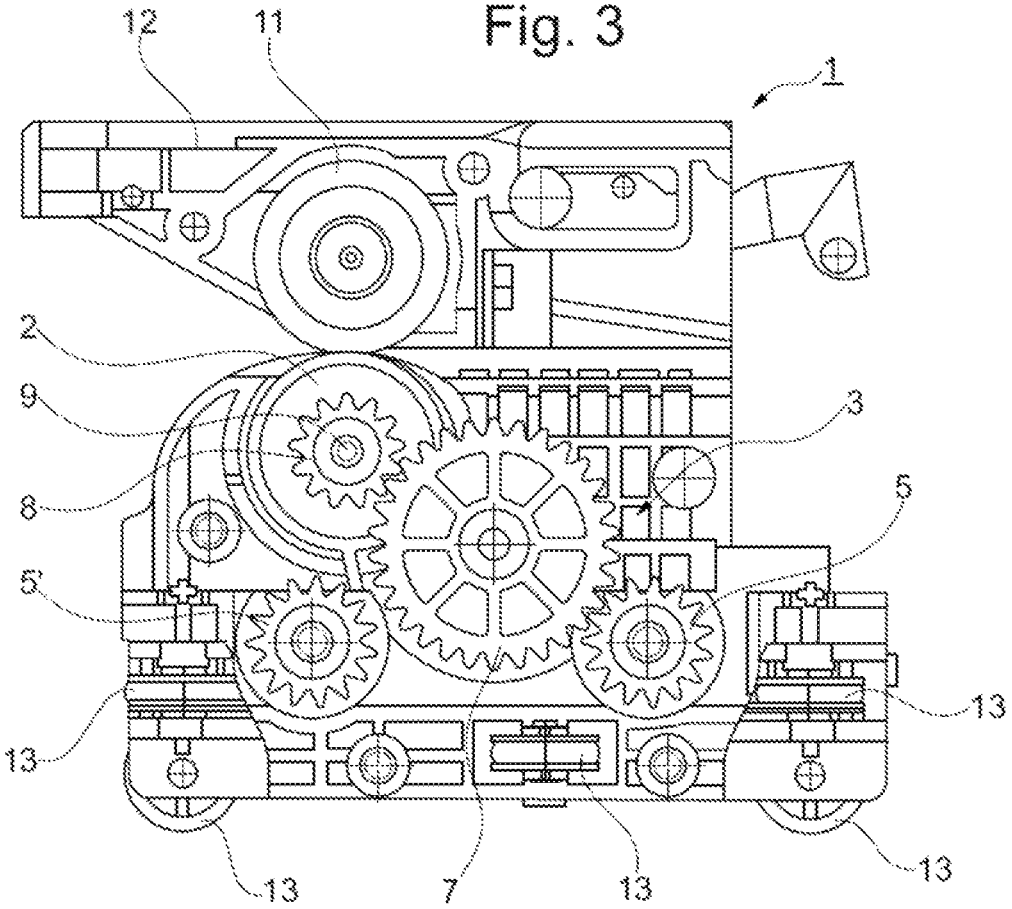

The driving arrangement 3 may comprise a driving member 5, such as for example a pinion 5 as shown in FIGS. 2 and 3, arranged to engage a guide assembly 6 of the printing apparatus. For example, such a guide assembly may comprise a rack 6 (see FIG. 2) intended to mesh with the pinion 5. The displacement of the cutter along the rack 6 causes the pinion 5 to rotate. A second pinion 5' may also mesh with the rack 6, for a better support of the cutter 1 during its displacement.

The driving arrangement 3 may further comprise a transmission from the driving member 5 to the active cutting wheel 2. In some examples, such as those of FIGS. 2 and 3, the transmission comprises a gear train. The gear train may comprise, for example, an intermediate gear wheel 7 meshing with pinion 5, and a gear wheel 8, which is mounted about a shaft 9 of the active cutting wheel 2 and meshes with the intermediate gear wheel 7.

In other examples of a cutter as disclosed herein the active cutting wheel 2 is driven in rotation independently from the displacement of the cutter itself across the media: for example by employing a motor or another kind of actuator, under the control of a control unit.

In some examples, such as those of FIGS. 2 and 3, the cutter 1 comprises another cutting element, such as a freely rotatable cutting wheel 11 that may rotate freely on its axis. The freely rotatable cutting wheel 11 may cooperate with the active cutting wheel 2 in order to cut the print medium between them. The freely rotatable cutting wheel 11 may rotate by virtue of its contact with the active cutting wheel 2. In other examples the print medium is cut by cooperation of the active cutting wheel 2 with an anvil or with a fixed cutting element.

As shown in the examples of FIGS. 2 and 3, the cutting wheels 2 and 11, as well as the driving arrangement 3, are mounted in a cutter housing 12. FIG. 3 also shows that in some examples the cutter 1 comprises guiding wheels 13 intended to guide the displacement of the cutter 1 by being engaged in the guide assembly of the printing apparatus In some examples of cutters as disclosed herein, the driving arrangement 3 comprises a clutch arranged to selectively engage or disengage one element of the driving arrangement 3 with respect to another element of the driving arrangement 3.

Such a clutch may be engaged for example for transmitting a torque to the active cutting wheel 2 when the cutter 1 is displaced in the first direction $X_1$. The active cutting wheel 2 is therefore driven in rotation. The clutch may be disengaged to interrupt the transmission of torque to the active cutting wheel 2 when the cutter 1 is displaced in the second direction $X_2$ opposite to the first direction $X_1$. The active cutting wheel 2 may then be idle.

In some examples of driving arrangements, for example those shown in FIGS. 2 and 3, a clutch 10 is arranged between the shaft 9 of the active cutting wheel 2 and the gear wheel 6 that is mounted about the shaft 9, as will be explained in more detail later on with reference to FIGS. 4 and 5.

In some examples, the clutch 10 provided in the cutter 1 is a one-way clutch: that is, a clutch that transmits torque only in one direction of rotation, and in the opposite direction of rotation it transmits no torque.

In some examples, the clutch 10 is a drawn cup roller clutch. Drawn cup roller clutches are one-way clutches that can transmit torques in one direction and may be radially compact. They may comprise an outer ring with a series of ramps on the inside diameter, needle rollers held in place with respect to the outer ring by suitable cages, and springs to urge the rollers in one direction against the ramps.

An example of such a clutch that may be suitable in some cutters as disclosed herein is drawn cup roller clutch HF0306-KF-R, available from Schaeffler AG (Germany).

Figure 4:
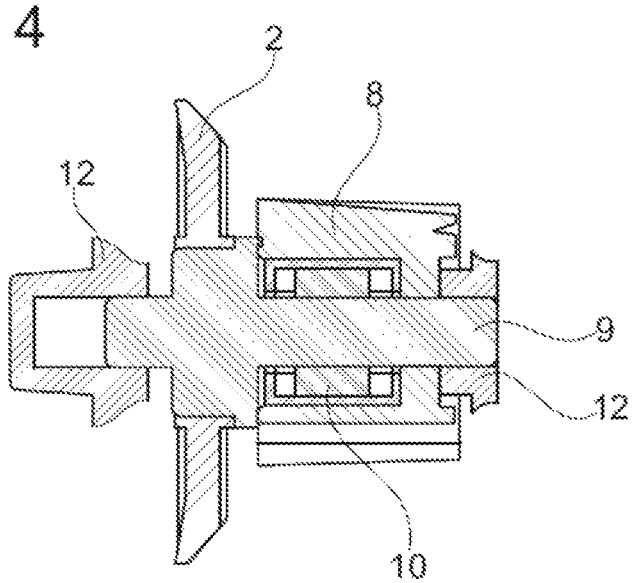
FIG. 4 is a section of a part of FIG. 3.
Figure 5:
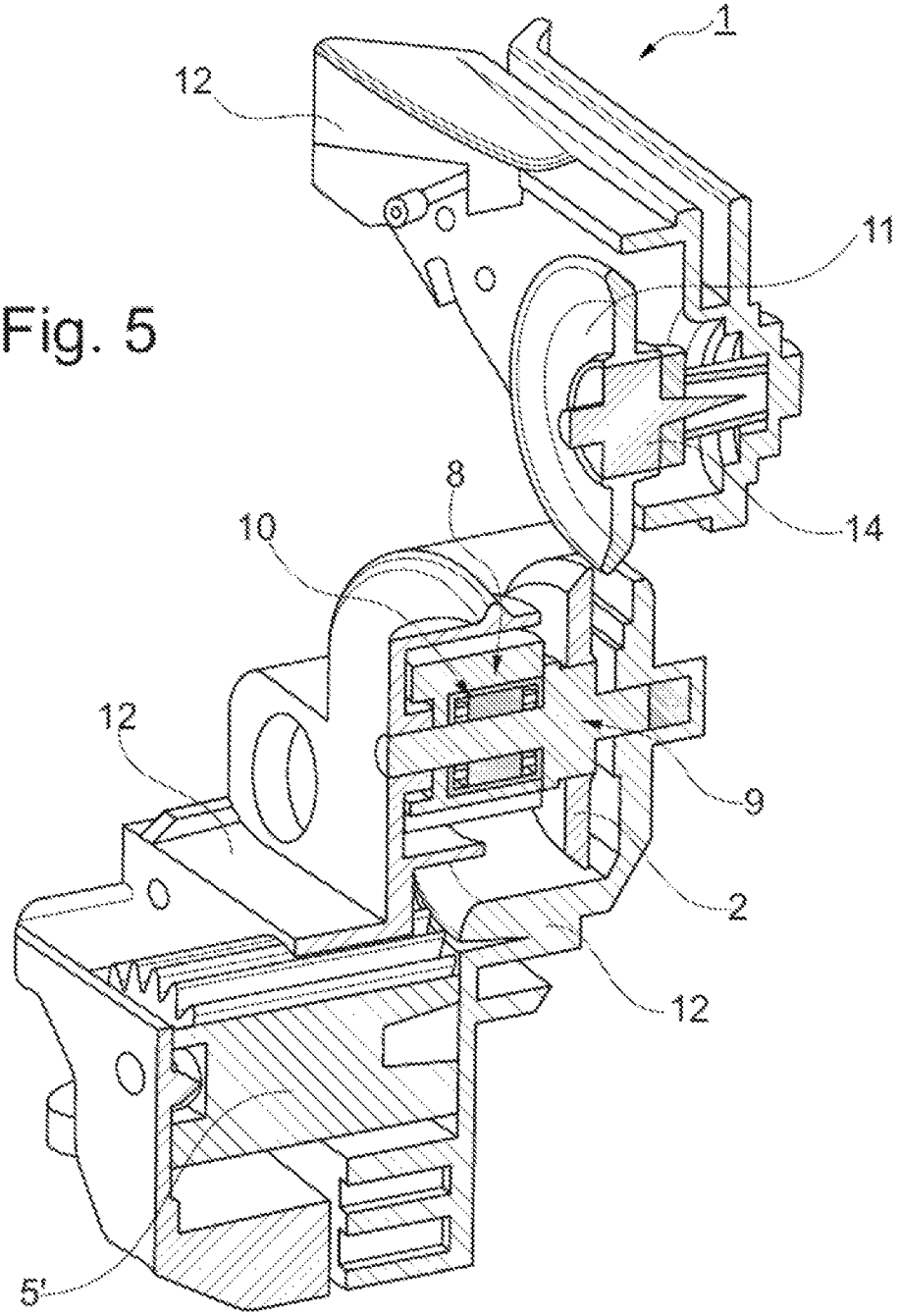
FIG. 5 is a schematic perspective view, partially cut away, of an example cutter such as that of FIGS. 3 and 4.

FIGS. 4 and 5 show schematically in section and perspective, respectively, some details of example cutters such as that of FIG. 3 or such as that of FIG. 2, although the same features may be employed in cutters with a different structure from that of these figures. Similarly, the cutters of FIG. 2 or 3 may also have a different configuration, for example a different configuration of the clutch or other devices of selectively engaging and disengaging the driving arrangement 3 with respect to the active cutting wheel 2.

FIG. 4 shows an example of the arrangement of a one-way clutch 10. such as a drawn cup roller clutch, between the shaft 9 on which the active cutting wheel 2 may be keyed and the gear wheel 8 mounted about the shaft 9. The shaft 9 may be mounted in such a way that it can rotate in the housing 12 of the cutter. When the gear wheel 8 rotates in one direction, the clutch 10 is engaged and transmits the torque from the gear wheel 8 to the shaft 9, so that the active cutting wheel 2 is driven in rotation. When the gear wheel 8 rotates in the opposite direction, the clutch 10 is disengaged and transmits no torque to the shaft 9, so that the active cutting wheel 2 remains idle.

FIG. 5 shows in perspective part of the elements of an example cutter 1 such as that of FIGS. 3 and 4; namely; the housing 12; the driving pinion 5'; the active cutting wheel 2 mounted on shaft 9, which in turn has the gear wheel 8 mounted about it with interposition of a clutch 10, as explained with respect to FIG. 4; and the freely rotating cutting wheel 11, mounted on a shaft 14, which rotates by virtue of its contact with active cutting wheel 2.

The operation of a cutter according to some examples is described in the following with reference to FIG. 2.

When the print medium in the printing apparatus has to be cut, the cutter 1 may be displaced in the direction $X_1$ along the guide assembly of the apparatus that includes the rack 6. As a consequence of this displacement, the driving pinion 5 meshing with the rack 6 rotates in a first direction, and this rotation is transmitted to the intermediate gear wheel 7 and from here to the gear wheel 8 mounted about the shaft 9 of the active cutting wheel 2. With the rotation in this first direction, the one-way clutch 10 (FIGS. 4 and 5) is engaged and transmits the torque from gear wheel 8 to shaft 9. Consequently, the active cutting wheel 2 is driven in rotation, and it also drives in rotation the free rotating cutting wheel 11. The print medium to be cut extends between the active cutting wheel 2 and the free rotating cutting wheel 11, and is cut by the cooperation of these two wheels.

When the cutter 1 has to return back to the starting position, it is displaced in the direction $X_2$ shown in FIG. 2. In this case, the driving pinion 5 meshing with the rack 6 rotates in a second direction, opposite the first direction, and this rotation is transmitted to the intermediate gear wheel 7, and from here to the gear wheel 8 mounted about the shaft 9 of the active cutting wheel 2. With the rotation in this second direction, the one-way clutch 10 (FIGS. 4 and 5) is disengaged and does not transmit torque from gear wheel 8 to shaft 9. Consequently, the active cutting wheel 2 is not driven in rotation, and remains idle, and the free rotating cutting wheel 11 also remain idle.

In further examples, a clutch is selectively engaged and disengaged at the right times by an actuator, for example under the control of a control unit.

In some other examples, a cutter as disclosed herein comprises a clutch or similar mechanism arranged for selectively engaging and disengaging other elements of the cutter. For example, in an example such as that of FIG. 2, a clutch is arranged for selectively engaging and disengaging at the right times the driving pinion 5 from the rack 6.

Some tests were performed to verify the efficiency of examples of cutters as disclosed herein. Example cutters with the features of FIGS. 3 and 4 were compared to cutters with a similar configuration but without a clutch, and showed both a life increase of the active cutting wheel and a lower level of noise.

In one example, test were performed to compare the performance of a cutter as disclosed herein with that of a cutter without a clutch, in the same printing apparatus and cutting the same print medium. After 1000 cutting and return cycles, in the return stroke the noise of the cutter having no clutch was 61 dB, while the noise the cutter with a clutch as disclosed herein was reduced to 57 dB. In the cutting stroke the noise was also reduced, from 69 dB to 66.5 dB, due to the smaller wear suffered by the active cutting wheel in the cutter with a clutch.

Examples of printing apparatus may be provided with examples of cutters as disclosed above. For example, a printing apparatus such as that partially illustrated in FIG. 2 may comprise a print media cutter 1 with an active cutting wheel 2 arranged to reciprocate across a print medium, and a driving arrangement 3 to drive the active cutting wheel 2 in rotation during displacement of the cutter 1 in a first direction $X_1$ and to be disengaged from the active cutting wheel 2 during displacement of the cutter in a second direction $X_2$ opposite to the first direction.

As also illustrated in FIG. 2, some examples of a printing apparatus may further comprise a printhead assembly 4 to reciprocate across the print medium and to engage the print media cutter 1 and displace it across the print medium, and may comprise a guide along which the print media cutter can be displaced, the guide comprising a rack 6 and the cutter comprising a driving pinion 5 to engage the rack 6.

Examples of a method for cutting print media in a printing apparatus are also disclosed herein, and may comprise driving the cutting wheel in rotation while displacing the active cutting wheel of a cutter in a first direction across a print medium to cut the print medium (cutting stroke), and maintaining the cutting wheel idle while displacing the active cutting wheel in a second direction opposite to the first direction to reposition the cutting wheel before a subsequent cutting operation (return stroke).

The active cutting wheel may be displaced across the print medium along the scan axis direction X of the printing apparatus (see FIG. 2), and in some examples the displacement is performed by pulling or pushing the active cutting wheel with a reciprocating printhead assembly of the printing apparatus.

Although only a number of particular implementations and examples have been disclosed herein, further variants and modifications of the disclosed apparatus and methods are possible; other combinations of the features of implementations or examples described are also possible.

The invention claimed is:

1. A print media cutter for a printing apparatus, comprising:

an active cutting wheel to reciprocate across a print medium; and a driving arrangement to drive the active cutting wheel in rotation during displacement of the cutter in a first direction, and to be disengaged from the active cutting wheel during displacement of the cutter in a second direction opposite to the first direction, wherein the driving arrangement comprises a one-way clutch to selectively engage or disengage one element of the driving arrangement with respect to another element of the driving arrangement.

2. A cutter as claimed in claim 1, wherein the one element of the driving arrangement is a shaft of the active cutting wheel, and the other element of the driving arrangement is a gear mounted about the shaft of the active cutting wheel.

3. A cutter as claimed in claim 1, wherein the one-way clutch is a drawn cup roller clutch.

4. A cutter as claimed in claim 1, wherein the driving arrangement comprises:

a driving member to engage a guide mounted on the printing apparatus, such that the driving member rotates when the cutter is displaced along the guide; and a transmission from the driving member to the active cutting wheel.

5. A cutter as claimed in claim 4, wherein the driving member comprises a driving pinion to mesh with a rack provided on the guide, and the transmission comprises a gear train.

6. A cutter as claimed in claim 1, further comprising, a freely rotatable cutting wheel cooperating with the active cutting wheel to cut the print medium.

7. A printing apparatus, comprising:

a print media cutter, the print media cutter comprising:

an active cutting wheel to reciprocate across a print medium; and a driving arrangement to drive the active cutting wheel in rotation during displacement of the cutter in a first direction, and to be disengaged from the active cutting wheel during displacement of the cutter in a second direction opposite to the first direction, wherein the driving arrangement comprises a one-way clutch to selectively engage or disengage a shaft of the active cutting wheel with respect to a gear mounted about the shaft of the active cutting wheel.

8. A printing apparatus as claimed in claim 7, further comprising:

a printhead assembly to reciprocate across the print medium and to engage the print media cutter and displace it across the print medium.

9. A printing apparatus as claimed in claim 7, further comprising:

a guide along which the print media cutter can be displaced, the guide comprising a rack and the cutter comprising a driving pinion to engage the rack.

10. A method for cutting print media in a printing apparatus, comprising:

driving an active cutting wheel in rotation while displacing a cutter including the active cutting wheel in a first direction across a print medium to cut the print medium; and maintaining the active cutting wheel idle while displacing the cutter in a second direction opposite to the first direction to reposition the cutting wheel before a subsequent cutting operation, by using a one-way clutch to selectively engage a shaft of the active cutting wheel with respect to a gear mounted about the shaft of the active cutting wheel.

11. A method as claimed in claim 10, wherein the active cutting wheel is displaced across the print medium along a scan axis direction X of the printing apparatus.

12. A method as claimed in claim 11, wherein the active cutting wheel is displaced across the print medium by being pulled or pushed by a reciprocating printhead assembly of the printing apparatus.

* * * * *